US007370498B1

(12) United States Patent
Miao

(10) Patent No.: US 7,370,498 B1
(45) Date of Patent: May 13, 2008

(54) DUAL-MODE PADLOCK

(75) Inventor: Tony Miao, Taipei Hsien (TW)

(73) Assignee: Jin Tay Industries Co., Ltd., Taipei Hsien (TW)

( * ) Notice: Subject to any disclaimer, the term of this patent is extended or adjusted under 35 U.S.C. 154(b) by 0 days.

(21) Appl. No.: 11/804,384

(22) Filed: May 18, 2007

(51) Int. Cl.
*E05B 37/06* (2006.01)

(52) U.S. Cl. ..... 70/21; 70/284; 70/285; 70/38 R; 70/25

(58) Field of Classification Search ..... 70/21–30, 70/38 R–38 C, 49, 284, 285, 312, 386
See application file for complete search history.

(56) References Cited

U.S. PATENT DOCUMENTS

| | | | | |
|---|---|---|---|---|
| 2,931,204 | A * | 4/1960 | Check | 70/21 |
| 4,462,231 | A * | 7/1984 | Zabel | 70/21 |
| 4,730,467 | A * | 3/1988 | Lebrecht | 70/25 |
| 4,998,422 | A * | 3/1991 | Borgmann et al. | 70/38 A |
| 6,029,481 | A * | 2/2000 | Lai | 70/25 |
| 6,381,997 | B1 * | 5/2002 | Chen | 70/28 |
| 6,539,761 | B2 * | 4/2003 | Yang | 70/284 |
| 6,813,913 | B2 * | 11/2004 | Watts | 70/38 A |
| 6,997,023 | B1 * | 2/2006 | Huang | 70/21 |
| 7,117,698 | B2 * | 10/2006 | Lai | 70/21 |
| 7,131,299 | B1 * | 11/2006 | Huang | 70/21 |
| 7,152,439 | B1 * | 12/2006 | Chang | 70/30 |
| 7,159,422 | B1 * | 1/2007 | Misner et al. | 70/21 |
| 7,201,026 | B2 * | 4/2007 | Yu | 70/21 |
| 7,213,425 | B2 * | 5/2007 | Ling et al. | 70/21 |
| 7,216,517 | B2 * | 5/2007 | Ling et al. | 70/21 |
| 7,293,439 | B1 * | 11/2007 | Miao | 70/21 |
| 2002/0166351 | A1 * | 11/2002 | Lee | 70/49 |
| 2005/0039500 | A1 * | 2/2005 | Yu | 70/25 |
| 2005/0235705 | A1 * | 10/2005 | Ling et al. | 70/25 |
| 2005/0235706 | A1 * | 10/2005 | Ling et al. | 70/29 |
| 2006/0027000 | A1 * | 2/2006 | Yu | 70/21 |
| 2006/0130540 | A1 * | 6/2006 | Lin | 70/21 |
| 2006/0179899 | A1 * | 8/2006 | Yu | 70/21 |

* cited by examiner

*Primary Examiner*—Suzanne Dino Barrett
(74) *Attorney, Agent, or Firm*—William E. Pelton, Esq.; Cooper & Dunham LLP

(57) ABSTRACT

A dual-mode padlock can be unlatched by dialing a combination assembly or an associated key. The dual-mode padlock has a latching element movably mounted inside to engage with or disengage from a latch. When the dual-mode padlock is locked, the user can directly push the latch into a mounting groove to engage with the latching element and make the dual-mode padlock locked, without use of the associated key or dialing of the combination assembly. This makes it timesaving and convenient to lock the dual-mode padlock.

11 Claims, 9 Drawing Sheets

DUAL-MODE PADLOCK

BACKGROUND OF THE INVENTION

1. Field of the Invention

The present invention relates to a lock, and more particularly to a dual-mode padlock that is timesaving and convenient to lock.

2. Description of Related Art

Locks are used to prevent articles from being stolen. Different locks may have different structures and are locked or unlocked in different ways.

For example, a padlock generally has a protruding latch and a latching hole formed on the padlock corresponding to the latch. A user commonly unlocks the padlock via insertion and rotation of an associated key, otherwise, the user may also dials a combination assembly to unlatch the padlock.

As for the padlock is locked, the user can push the latch to insert into the latching hole and be latched, such that an article can be securely fastened at a position.

However, the latch is latched only when the associated key inserted in the padlock or the combination assembly in an unlocked condition. This makes it time-consuming and inconvenient to lock the padlock.

To overcome the shortcomings, the present invention provides a dual-mode padlock to obviate or mitigate the aforementioned problems.

SUMMARY OF THE INVENTION

The main objective of the present invention is to provide a dual-mode padlock that is unlatched in two modes and has a latch allows a user to push the latch directly to be latched in a corresponding latching hole.

To achieve the objective, the dual-mode padlock in accordance with present invention comprises a housing, a latch, a combination assembly and a cylinder mechanism.

The housing has a latching hole and a longitudinal mounting groove, and the mounting groove has a latching element mounted inside. The latch protrudes from the housing and is mounted movably in the mounted groove and has a latching end corresponding to the latching hole of the housing and selectively engaged with the latching element.

The combination assembly comprises multiple wheel assemblies that allow the user to rotate to therefor actuate the latching element to disengage from the latch and make the dual-mode padlock unlock.

The cylinder mechanism has a keyhole for an associated key to insert into actuate the latching element to disengage from the latch and make the dual-mode padlock unlock.

When the dual-mode padlock is locked, the user can directly push the latch into the mounting groove to engage the latch with the latching element and make the dual-mode padlock locked.

Accordingly, the dual-mode padlock is locked without turning the associated key or the combination assembly and to lock the padlock is timesaving and convenient.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
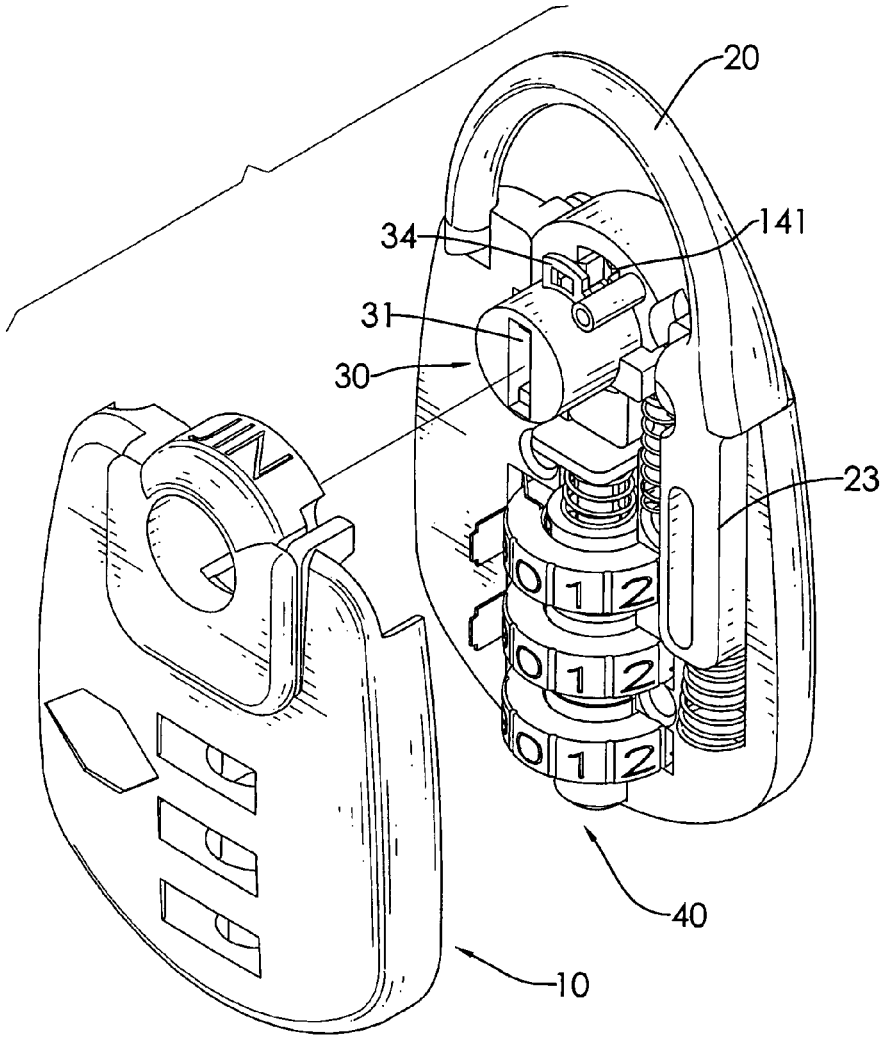
FIG. 1 is a partially exploded perspective view of a dual-mode padlock in accordance with the present invention.

With reference to FIGS. 1, 2, 3 and 8, the dual-mode padlock in accordance with present invention comprises a housing (10), a latch (20) (20'), an associated key (50), a cylinder mechanism (30) and a combination assembly (40).

The housing (10) comprises two halves and has a top, an outer surface, two sides, a latching hole (17), a combination chamber (11), a receiving notch (12), a cylinder chamber (13), a mounting groove (15) and a latching element (16).

The two halves attach to each other to form the housing (10), and each half has an outer surface and multiple openings (111). The openings (111) are formed through the outer surface and are aligned with each other, and the openings (111) in one half align respectively with the openings (111) in the other half.

The latching hole (17) is defined in the outer surface on the top of the housing (10) near one side.

The combination chamber (11) corresponds to the openings (111) in the halves of the housing (10) and has multiple wheel recesses (110). The wheel recesses (110) respectively align and communicate with the openings (111) in the halves of the housing (10).

The receiving notch (12) is formed in the housing (10) adjacent to the combination chamber (11) and communicates respectively with the wheel recesses (110) in the housing (10).

The cylinder chamber (13) is formed through the top of the housing (10) in-line with the combination chamber (11) and has two sides, a second resilient element (130) and a holding bracket (14). The second resilient element (130) is mounted securely in one side of the cylinder chamber (13) and has a top end. The holding bracket (14) is mounted slidably in the cylinder chamber (13) and has a top, a bottom, an outer surface, a center, a holding recess (140), a first engaging notch (142), a second engaging notch (143) and a pushing rod (144). The top of the holding bracket (14) protrudes from the top of the housing (10). The holding recess (140) is formed in the center of the holding bracket (14) and has an inner surface and two latching notches (141) formed in the inner surface and opposite to each other. The first engaging notch (142) and the second engaging notch (143) are formed in the outer surface of the holding bracket (14) adjacent to each other. The pushing rod (144) protrudes from the bottom of the holding bracket (14).

The mounting groove (15) is formed longitudinally in the housing (10) near the side opposite to the latching hole (17)

and has a top opening, a bottom, an inner surface, a limit (150), a first resilient element (151) and a latching channel (152). The top opening is formed in the outer surface of the housing (10). The limit (150) is formed on the inner surface near the top opening of the mounting groove (15). The first resilient element (151) is mounted in the mounting groove (15) and has a top end. The latching channel (152) is formed through the inner surface of the mounting groove (15), communicates with the cylinder chamber (13) and selectively aligns with the first engaging notch (142) and the second engaging notch (143).

The latching element (16) is spherical, is movably arranged in the latching channel (152) and selectively engages the first engaging notch (142) and the second engaging notch (143).

The latch (20) is J-shaped and includes a mounting portion (23) and a latching portion. The mounting portion (23) is slidably mounted in the mounting groove (15) of the housing (10) and has a side surface, a bottom end, a limit hole (24) and a latching recess (22). The bottom end abuts the top end of the first resilient element (151) and gradually compresses the first resilient element (151) in the mounting groove (15) when the mounting portion (23) slides downward. The limit hole (24) is elongated and is longitudinally formed through the mounting portion (23) of the latch (20) to receive the limit (150) in the mounting groove (15) and therefor limits the slide distance of the latch (20) relative to the housing (10). The latching recess (22) is formed in the side surface of the mounting portion (23) and selectively aligns with the latching channel (152) to engage with the latching element (16) and retain the latch (20) securely. The latching portion is bent, has a latching end (21) corresponding to the latching hole (17) of the housing (10) and is latched in the latching hole (17) when the latching recess (22) of the mounting portion (23) engages with the latching element (16).

The associated key (50) has a handle and a blade. The blade has an edge and a keycut (51) formed in the edge.

The cylinder mechanism (30) comprises a cylinder, multiple actuating elements (34) and multiple springs (35). The cylinder is mounted rotatably in the holding recess (140) and has an outer surface, a top, a bottom, two ends, a keyhole (31), multiple slits (32) and an actuating bar (33). The keyhole (31) is formed longitudinally through one end of the cylinder and allows an associated key (50) to insert into. The slits (32) are formed diametrically in the top and the bottom of the cylinder and communicate with the keyhole (31) respectively. The actuating bar (33) extends out from the outer surface of the cylinder and has a distal end abutting the top end of the second resilient element (130) of the cylinder chamber (13) and gradually compressing the second resilient element (130) when the holding bracket (14) moves downward or the cylinder is rotated.

Figure 6:
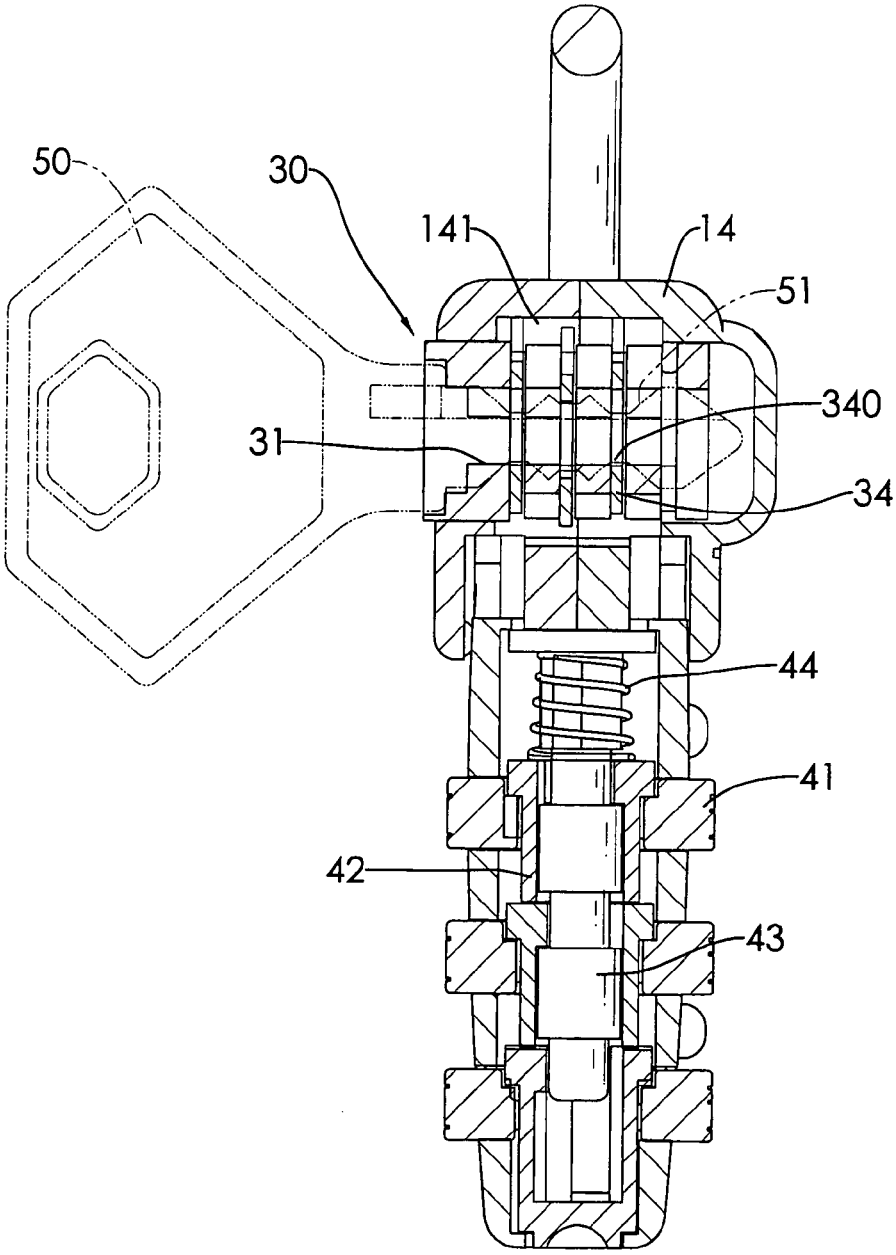
FIG. 6 is an operational side view of the dual-mode padlock in FIG. 1 showing an associated key inserted into the keyhole of the cylinder.

The actuating elements (34) are flat and are movably mounted in the slits (32) of the cylinder, respectively. Each actuating element (34) has a center, two sides, a central aperture (340) and a salient (341). With further reference to FIG. 6, the central aperture (340) is formed through the center of the actuating element (34) and has a length according to the keycut (51) of the associated key (50) and allows the actuating element (34) to be drawn back in the corresponding slit (32) when the associated key (50) is inserted in the keyhole (31). The springs (35) are mounted in the slits (32) and abut the salients (341) of the actuating elements (34) to make the actuating elements (34) protruding from the slit (32) and engaging in the latching notches (141) of the holding recess (140) of the holding bracket (14) to retain the cylinder in position.

Figure 2:
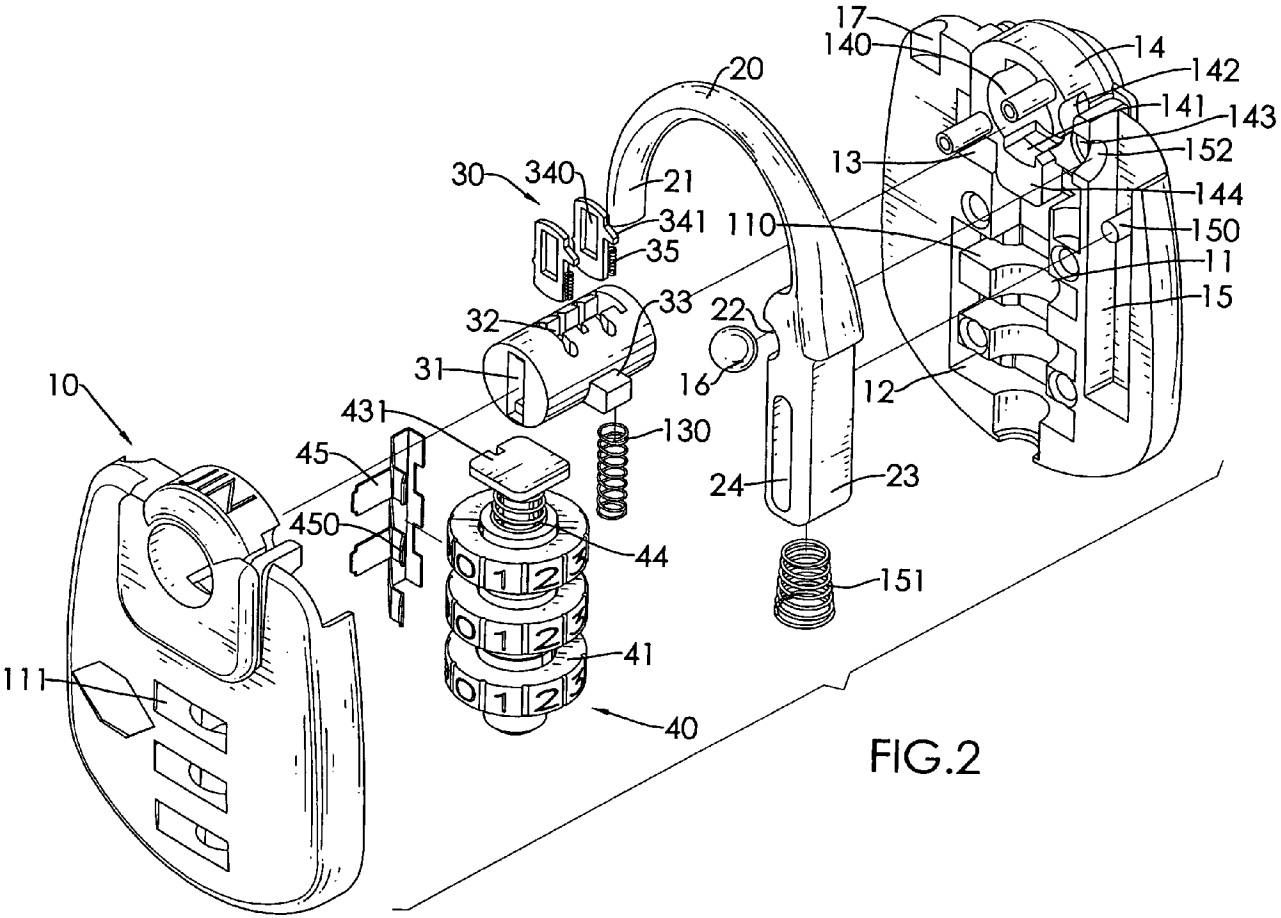
FIG. 2 is an exploded perspective view of the dual-mode padlock in FIG. 1.
Figure 3:
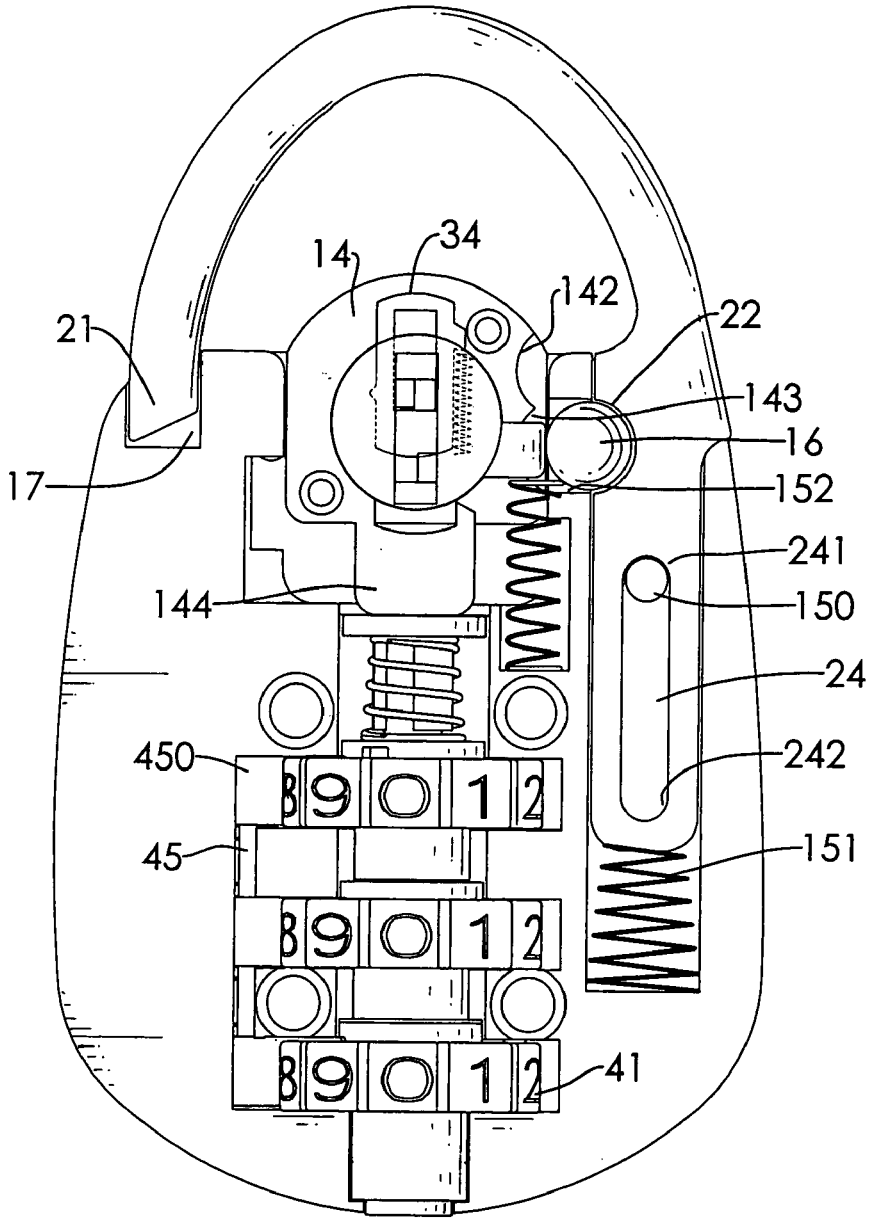
FIG. 3 is a front view of the dual-mode padlock in FIG. 1 with internal components shown in phantom lines.
Figure 4:
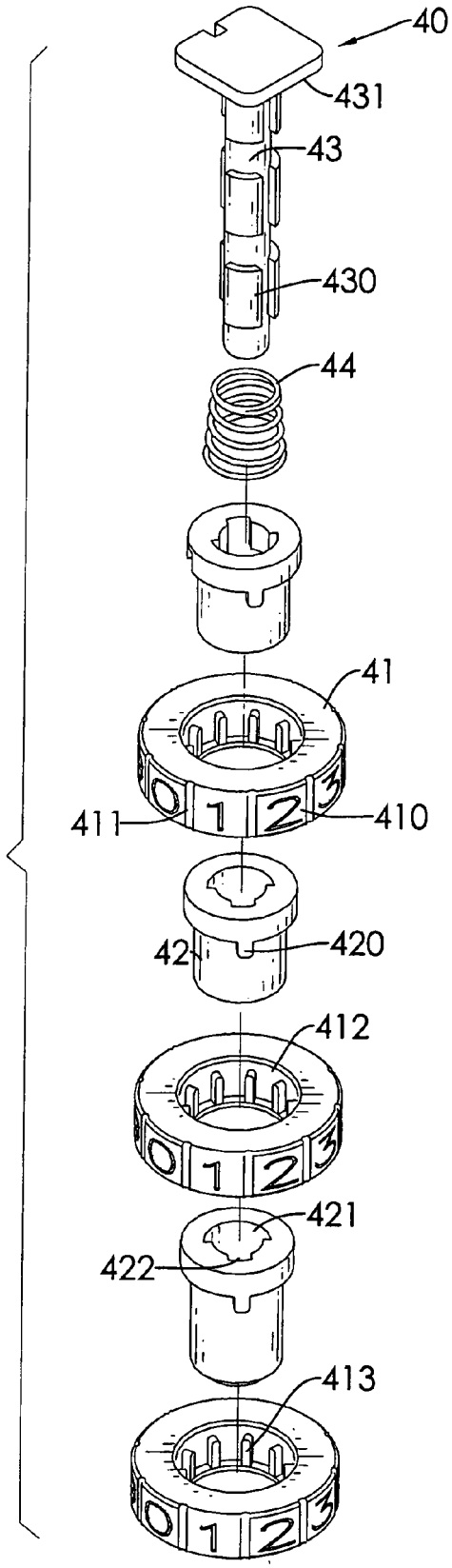
FIG. 4 is an exploded perspective view of the combination assembly of the dual-mode padlock in FIG. 1.

With reference to FIGS. 2 and 4, the combination assembly (40) is mounted in the combination chamber (11) of the housing (10) and comprises a pintle (43), multiple wheel assemblies, a resilient detent (45) and a retaining spring (44).

The pintle (43) is movably mounted longitudinally in the combination chamber (11) and has a surface, multiple protrusions (430) formed separately on the surface and a top stage (431) abutting the pushing rod (144) of the holding bracket (14), such that the pintle (43) can be pushed to move downward when the holding bracket (14) is compressed. The multiple protrusions (430) are formed into multiple groups.

The wheel assemblies are mounted rotatably around the pintle (43) respectively in the wheel recesses (110) and correspond respectively to the openings (111) of the housing (10). Each wheel assembly includes a wheel (41) and a wheel bracket (42). The wheel (41) has an outer edge, a central hole (412), multiple flutes (411) and multiple teeth (413). The central hole (412) is formed through the wheel (41) and has an inner edge. The flutes (411) are formed around the outer edge of the wheel (41) and divide the outer edge into equal segments. Each segment has a unique number (410). The teeth (413) are formed on and protrude in from the inner edge of the central hole (412) and define multiple recesses between the teeth (413). The wheel bracket (42) is tubular, is mounted rotatably around the pintle (43), corresponds respectively to and are held on one of the wheels (41), and has a top, a bottom, a flange, a combination hole (421) and at least one retaining tooth (420). The flange is formed on and protrudes radially out from the top of the wheel bracket (42) and is mounted in the central hole (412) of the wheel (41) and is supported by the teeth (413). The combination hole (421) is formed longitudinally through the wheel bracket (42) and has an inner edge and multiple holding recesses (422). The holding recesses (422) are defined in the inner edge of the combination hole (421) and correspond to and selectively hold a corresponding group of protrusions (430) on the pintle (43) when the pintle (43) is compressed. The retaining teeth (420) are formed around the wheel bracket (42) below the flange and engage one recess between a pair of adjacent teeth (413) in the central hole (412) of the wheel (41), such that the wheel brackets (42) will rotate with the wheels (41) simultaneously.

The resilient detent (45) is mounted securely in the receiving notch (12) of the housing (10) and has multiple retaining ends (450). The retaining ends (450) respectively abut and slide on the outer edge of the wheels (41) and engage the flutes (411) on the wheels (41) to hold the number (410) on the wheel (41) squarely in the corresponding opening (111).

The retaining spring (44) is mounted around the pintle (43) between the top stage (431) of the pintle (43) and the flange of an uppermost one of the wheel brackets (42) to push the pintle (43) upward when the pintle (43) is released.

Figure 8:
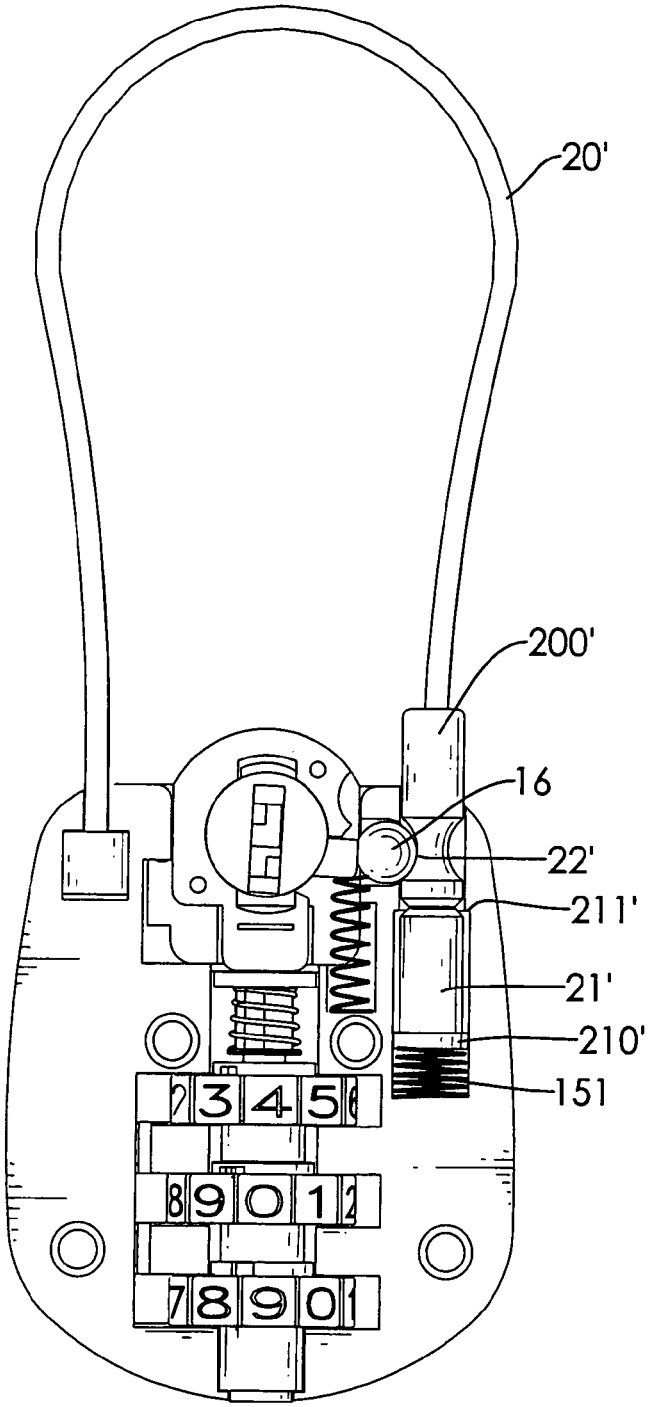
FIG. 8 is a front view of an another embodiment of a dual-mode padlock in accordance with present invention.

Furthermore, with reference to FIG. 8, in an another embodiment of the dual-mode padlock in accordance with present invention, the mounting groove (15) is formed longitudinally in the housing (10) beside combination chamber (11) and has a top opening, a bottom, an inner surface, a first resilient element (151), a latching channel (152), an inner salient (211') and a holding block (21'). The top opening is formed in the outer surface of the housing (10). The first resilient element (151) is mounted in the mounting groove (15) and has a top end. The latching channel (152) is formed through the inner surface of the mounting groove (15), communicates with the cylinder chamber (13) and selectively aligns with the first engaging notch (142) and the second engaging notch (143). The inner salient (211') is formed on the inner surface near the top opening of the mounting groove (15) of the housing (10). The holding block (21') is mounted on the top end of the first resilient element (151) and has a top, a bottom and a flange (210'). The flange (210') is formed around the bottom of the holding block (21') and selectively abuts the inner salient (211') of the mounting groove (15) to stop the holding block (21') and prevent the holding block (21') from escaping from the mounting groove (15).

Additionally, the latch (20') is flexible, may be a cable wire and has a proximal end, a distal end and a latching block (200'). The proximal end is mounted securely in the latching hole (17) of the housing (10). The latching block (200') connects securely to the distal end of the latch (20'), pushes the holding block (21') to move downward when the latching block (200') is pushed into the mounting groove (15) and has a latching recess (22') selectively aligning with the latching channel (152) to engage with the latching element (16) and retain the latch (20') securely.

Figure 5:
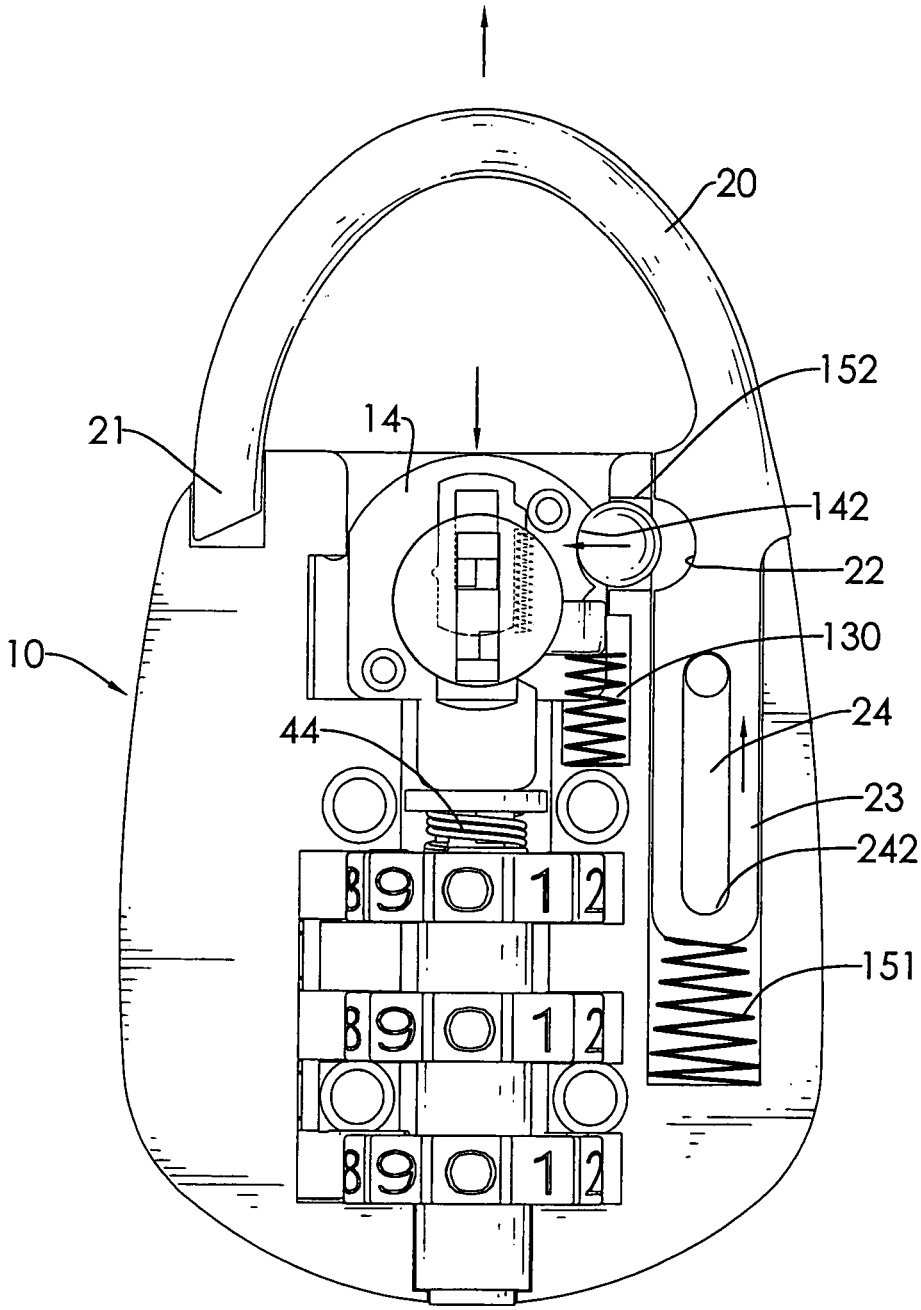
FIG. 5 is an operational front view of the dual-mode padlock in FIG. 3 showing the latch is unlatched.

With reference to FIGS. 2 and 5, when the dual-mode padlock is unlocked, a user rotates the wheels (41) according to the numbers (410). When the wheels (41) are rotated to positions base on a predetermined code, the wheel brackets (42) are rotated with the wheels (41) to a position where the holding recesses (422) in all the wheel brackets (42) align with the protrusions (43) on the pintle (43). Before the wheels (41) being rotated to the predetermined code, the pintle (43) is kept from being moving downward due to being blocked by the flanges on the wheel brackets (42). Thus, the user can press the holding bracket (14) to move the pintle (43) downward and make the protrusions (430) on the pintle (43) extending into and held in the corresponding holding recesses (422). Such that the actuating bar (33) may gradually compress the second resilient element (130) and therefore allows the latching element (16) to extend out from the latching channel (152) and engage with the first engaging notch (142) of the holding bracket (14) and thereby retain the position of the holding bracket (14). Accordingly, the latching recess (22) disengages from the latching element (16) so that the latch (20) can be pushed upward by the first resilient element (151) to disengage the latching end (21) from the latching hole (17) of the housing (10).

Figure 7:
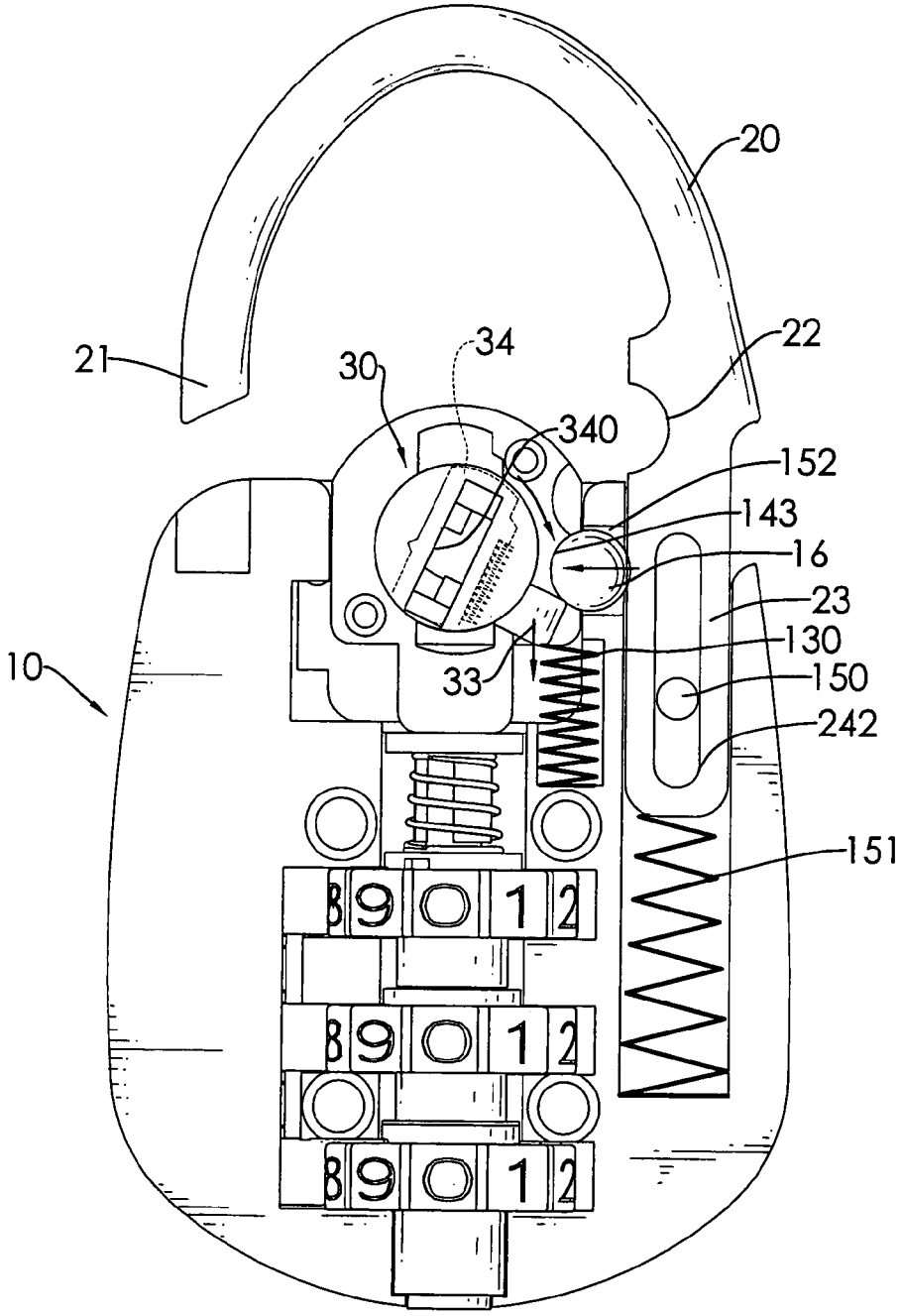
FIG. 7 is an operational front view of the dual-mode padlock in FIG. 3 showing the cylinder is rotated.

With further reference to FIG. 7, in another operation embodiment, the user can insert the associated key (50) into the keyhole (31) of the cylinder and rotate the key (50), such that the actuating bar (33) may compress the second resilient element (130) and therefore allows the latching element (16) to extend out the latching channel (152) and engage with the second engaging notch (143) of the holding bracket (14). Accordingly, the latching recess (22) disengages from the latching element (16) so that the latch (20) can be pushed upward by the first resilient element (151) to disengage the latching end (21) from the latching hole (17) of the housing (10).

Figure 9:
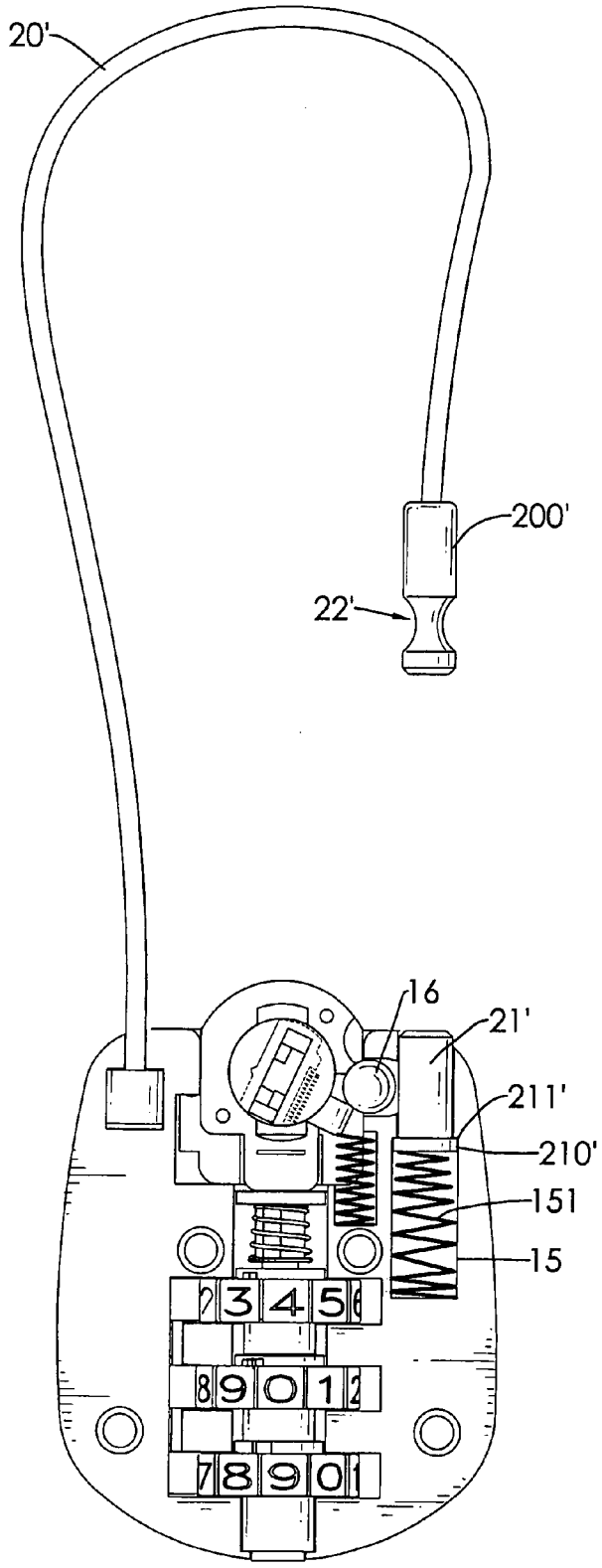
FIG. 9 is an operational front view of the dual-mode padlock in FIG. 8 showing the latch is unlatched.

With reference to FIGS. 8 and 9, in the another embodiment of the dual-mode padlock in accordance with present invention, when the holding bracket (14) is pushed downward or the associated key (50) is inserted into the cylinder and rotated, the latch's (20') latching block (200') disengages from the latching element (16) and is pushed upward by the first resilient element (151) and the latch (20') is unlatched from the housing (10) thereby.

Accordingly, when the dual-mode padlock is locked, the user only have to press the latch (20) (20') to move downward until the latching end (21) of the latch (20) insert into the latching hole (17), or the latching block (200') be inserted into the mounting groove (15) to make the latching recess (22) (22') aligning with the latching channel (152). In such a manner, the latching element (16) will disengage from the first engaging notch (142) or the second engaging notch (143), then engages with the latching recess (22) (22') of the latch (20) (20') by the extension of the second resilient element (130) and the retaining spring (44) to hold the latch (20) (20') securely in the housing (10). So, locking the padlock is timesaving and convenient.

Even though numerous characteristics and advantages of the present invention have been set forth in the foregoing description together with details of the structure and function of the invention, the disclosure is illustrative only. Changes may be made in detail especially in matters of shape, size and arrangement of parts within the principles of the invention to the full extent indicated by the broad general meaning of the terms in which the appended claims are expressed.

What is claimed is:

1. A dual-mode padlock comprising a housing having a holding bracket being mounted slidably in housing and having a top protruding from the housing;

an outer surface;

multiple engaging notches being formed in the outer surface of the holding bracket and adjacent to each other;

a mounting groove being formed longitudinally in the housing and having a top opening;

a bottom;

an inner surface; and a latching channel being formed through the inner surface of the mounting groove selectively aligning with one of the engaging notches; and a latching element being movably arranged in the latching channel and selectively engaging with one of the engaging notches of the holding bracket;

a latch being mounted movably in the housing and having a latching recess selectively aligning with the latching channel to engage with and be retained by the latching element; and a cylinder mechanism having a cylinder being mounted rotatably in the holding bracket and having an outer surface; and an actuating bar extending out from the outer surface of the cylinder and having a distal end corresponding to the latching channel; and a combination assembly having a pintle being movably mounted longitudinally in the housing and abutting the holding bracket; and multiple wheel assemblies being mounted rotatably around the pintle respectively in the housing and being able to be rotated to determined positions where allowing the pintle and the holding bracket to move downward whereby the latching element engages with one of the engaging notches.

2. The dual-mode padlock as claimed in claim 1, wherein the housing has a top;

an outer surface;

two sides;
a combination chamber; and
a cylinder chamber being formed through the top of the housing;
the holding bracket is mounted slidably in the cylinder chamber of the housing;
the pintle of the combination assembly is movably mounted longitudinally in the combination chamber of the housing; and
the wheel assemblies of the combination assembly is mounted in the combination chamber of the housing.

3. The dual-mode padlock as claimed in claim 2, wherein
the mounting groove further has a first resilient element being mounted in the mounting groove and having a top end pushing the latch; and
the cylinder chamber further has a second resilient element being mounted securely in the cylinder chamber and having a top end abutting the actuating bar of the cylinder.

4. The dual-mode padlock as claimed in claim 3, wherein
the housing further has a latching hole being defined in the outer surface on the top of the housing near one side of the housing;
the mounting groove of the housing further has a limit being formed on the inner surface near the top opening of the mounting groove; and
the latch further has a
a latching end corresponding to the latching hole of the housing and being latched in the latching hole when the latching recess of the mounting portion engaging with the latching element;
a mounting portion being slidably mounted in the mounting groove of the housing and having
a side surface,
a bottom end abutting the first resilient element; and
a limit hole being elongated and being longitudinally formed through the mounting portion of the latch to receive the limit in the mounting groove to limit a slide distance of the latch relative to the housing, wherein
the latching recess is formed in the side surface of the mounting portion.

5. The dual-mode padlock as claimed in claim 3, wherein
the mounting groove further has
an inner salient being formed on the inner surface near the top opening of the mounting groove of the housing; and
a holding block being mounted on the top end of the first resilient element and having
a top;
a bottom; and
a flange being formed around the bottom of the holding block and selectively abutting the inner salient of the mounting groove;
the latch is flexible and has
a proximal end being mounted securely in the housing;
a distal end; and
a latching block connecting securely to the distal end of the latch and abutting the holding block; and
the latching recess is formed around the latching block.

6. The dual-mode padlock as claimed in claim 3, wherein
the holding bracket further has a holding recess being formed in the holding bracket and having
an inner surface; and
two latching notches formed in the inner surface of the holding recess and opposite to each other; and
the cylinder of the cylinder mechanism has
a top;
a bottom;
two ends;
a keyhole being formed longitudinally through one end of the cylinder; and
multiple slits being formed diametrically in the top and the bottom of the cylinder and communicating with the keyhole respectively; and
the cylinder mechanism further has
multiple actuating elements being flat and being movably mounted in the slits of the cylinder selectively, and each actuating element having
a center;
two sides;
a central aperture being formed through the center of the actuating element and having a length; and
a salient; and
multiple springs being mounted in the slits and abutting respectively the salients of the actuating elements to make the actuating elements protruding from the slits and engaging in the latching notches of the holding recess of the holding bracket to retain the cylinder in position.

7. The dual-mode padlock as claimed in claim 3, wherein
the housing further has multiple openings being formed through the outer surface and being aligned with each other;
the combination chamber of the housing further has multiple wheel recesses aligning and communicating with the openings of the housing, respectively; and
the pintle of the combination assembly having
a surface; and
multiple protrusions formed separately on the surface and formed into multiple groups; and
the wheel assemblies of the combination assembly being in the wheel recesses respectively and corresponding respectively to the openings of the housing, and each wheel assembly including
a wheel having
an outer edge;
a central hole being formed through the wheel and having an inner edge;
multiple flutes being formed around the outer edge of the wheel to divide the outer edge into equal segments, and each segment having a unique number; and
a wheel bracket being tubular, being mounted rotatably around the pintle, corresponding to and held on the wheel and having
a top;
a bottom;
a flange being formed on and protruding radially out from the top of the wheel bracket and being mounted in the central hole in the wheel; and
a combination hole being formed longitudinally through the wheel bracket, selectively holding a corresponding group of the protrusions on the pintle and having
an inner edge; and
multiple holding recesses defined in the inner edge of the combination hole and selectively aligning with and holding the corresponding group protrusions on the pintle.

8. The dual-mode padlock as claimed in claim 7, wherein
the holding bracket further has
a bottom; and a pushing rod protruding from the bottom of the holding bracket; and the pintle further has a top stage abutting the pushing rod of the holding bracket.

9. The dual-mode padlock as claimed in claim 8, wherein the combination assembly further has a retaining spring being mounted around the pintle between the top stage of the pintle and the flange of an uppermost one of the wheel brackets to push the pintle upward.

10. The dual-mode padlock as claimed in claim 7, wherein the combination assembly further has a resilient detent being mounted securely in the housing and having multiple retaining ends respectively abutting and sliding on the outer edge of the wheels and engaging the flutes on the wheels to hold the wheels in the corresponding opening.

11. The dual-mode padlock as claimed in claim 7, wherein each wheel further has multiple teeth being formed on and protruding in from the inner edge of the central hole; and each wheel bracket further has multiple retaining teeth being formed around the wheel bracket below the flange and engaging the teeth in the central hole of a corresponding one of the wheels.

* * * * *